US010480307B2

(12) United States Patent
Kelbie et al.

(10) Patent No.: US 10,480,307 B2
(45) Date of Patent: Nov. 19, 2019

(54) METHOD FOR PROVIDING WELL SAFETY CONTROL IN A REMEDIAL ELECTRONIC SUBMERSIBLE PUMP (ESP) APPLICATION

(71) Applicants: Graeme Michael Kelbie, Cypress, TX (US); Terry Bussear, Spring, TX (US); Lars Bay, Katy, TX (US)

(72) Inventors: Graeme Michael Kelbie, Cypress, TX (US); Terry Bussear, Spring, TX (US); Lars Bay, Katy, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 209 days.

(21) Appl. No.: 15/631,026

(22) Filed: Jun. 23, 2017

(65) Prior Publication Data

US 2017/0370206 A1 Dec. 28, 2017

Related U.S. Application Data

(60) Provisional application No. 62/354,914, filed on Jun. 27, 2016.

(51) Int. Cl.

| | |
|---|---|
| ***E21B 47/00*** | (2012.01) |
| ***E21B 33/076*** | (2006.01) |
| ***E21B 41/04*** | (2006.01) |
| ***F04B 49/03*** | (2006.01) |
| ***F04B 49/10*** | (2006.01) |

(52) U.S. Cl.

CPC ..... *E21B 47/0007* (2013.01); *E21B 33/076* (2013.01); *E21B 41/04* (2013.01); *F04B 49/03* (2013.01); *F04B 49/106* (2013.01)

(58) Field of Classification Search

CPC ..... E21B 4/0007; E21B 34/06; E21B 23/00; E21B 43/128

See application file for complete search history.

(56) References Cited

U.S. PATENT DOCUMENTS 4,625,798 A * 12/1986 Bayh, III ..... E21B 34/08 166/106
4,852,648 A * 8/1989 Akkerman ..... E21B 17/003 166/66.4
5,127,476 A * 7/1992 Dickson ..... E21B 34/105 166/317
5,293,943 A * 3/1994 Williamson, Jr. ..... E21B 34/10 166/319
6,142,237 A * 11/2000 Christmas ..... E21B 17/028 166/376
6,192,983 B1 2/2001 Neuroth et al.

(Continued)

FOREIGN PATENT DOCUMENTS

WO 2011153011 A2 12/2011

OTHER PUBLICATIONS

Notification of Transmittal of the International Search Report and the Written Opinion of the International Searching Authority, or the Declaration; PCT/US2017/039220; dated Oct. 27, 2017; 12 pages.

*Primary Examiner* — Jennifer H Gay
(74) *Attorney, Agent, or Firm* — Cantor Colburn LLP

(57) ABSTRACT

A method for providing well safety control in a remedial electronic submersible pump (ESP) application including a making up an electric submersible pump (ESP) on a conduit with a primary well control capability; running the foregoing through a preexisting SCSSV.

13 Claims, 2 Drawing Sheets

(56) References Cited

U.S. PATENT DOCUMENTS

| | | | | |
|---|---|---|---|---|
| 6,415,869 | B1 * | 7/2002 | Smith | E21B 17/028 166/381 |
| 6,776,230 | B2 * | 8/2004 | Collie | E21B 43/128 166/97.1 |
| 8,863,849 | B2 * | 10/2014 | Patel | E21B 43/128 166/373 |
| 9,587,462 | B2 * | 3/2017 | Giusti, Jr. | E21B 34/06 |
| 10,072,486 | B2 * | 9/2018 | Bennett | E21B 17/206 |
| 10,151,194 | B2 * | 12/2018 | Roth | E21B 47/09 |
| 2002/0040788 | A1 * | 4/2002 | Hill, Jr. | E21B 34/102 166/382 |
| 2003/0056956 | A1 | 3/2003 | Collie et al. | |
| 2007/0289747 | A1 * | 12/2007 | Shaw | E21B 43/128 166/368 |
| 2009/0001304 | A1 * | 1/2009 | Hansen | E21B 34/06 251/129.02 |
| 2012/0181043 | A1 | 7/2012 | Patel | |
| 2013/0043034 | A1 | 2/2013 | Drabilier et al. | |
| 2014/0096978 | A1 * | 4/2014 | Giusti, Jr. | E21B 34/06 166/386 |
| 2016/0168937 | A1 * | 6/2016 | Hess | F04D 13/10 166/369 |
| 2017/0370206 | A1 * | 12/2017 | Kelbie | E21B 43/128 |
| 2018/0066479 | A1 * | 3/2018 | Head | E21B 33/0407 |

* cited by examiner

METHOD FOR PROVIDING WELL SAFETY CONTROL IN A REMEDIAL ELECTRONIC SUBMERSIBLE PUMP (ESP) APPLICATION

CROSS REFERENCE TO RELATED APPLICATIONS

This application claims the benefit of an earlier filing date from U.S. Provisional Application Ser. No. 62/354,914 filed Jun. 27, 2016, the entire disclosure of which is incorporated herein by reference.

BACKGROUND

Wells that suffer from reduced formation pressure become a problem for operators. Such wells can be remediated to acceptable production levels with artificial lift methods but to determine which ones justify the investment represented by providing artificial lift consideration must be given. In some wells the cost of a conventional workover certainly is justifiable and operations to work the well over happen regularly. In other wells, however, the cost of bringing in a rig, pulling the tree, lifting the production string, etc. is prohibitive. These wells have traditionally simply been abandoned leaving potentially valuable resources out of reach.

BRIEF DESCRIPTION

A method for providing well safety control in a remedial electronic submersible pump (ESP) application including a making up an electric submersible pump (ESP) on a conduit with a primary well control capability; running the foregoing through a preexisting SCSSV.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
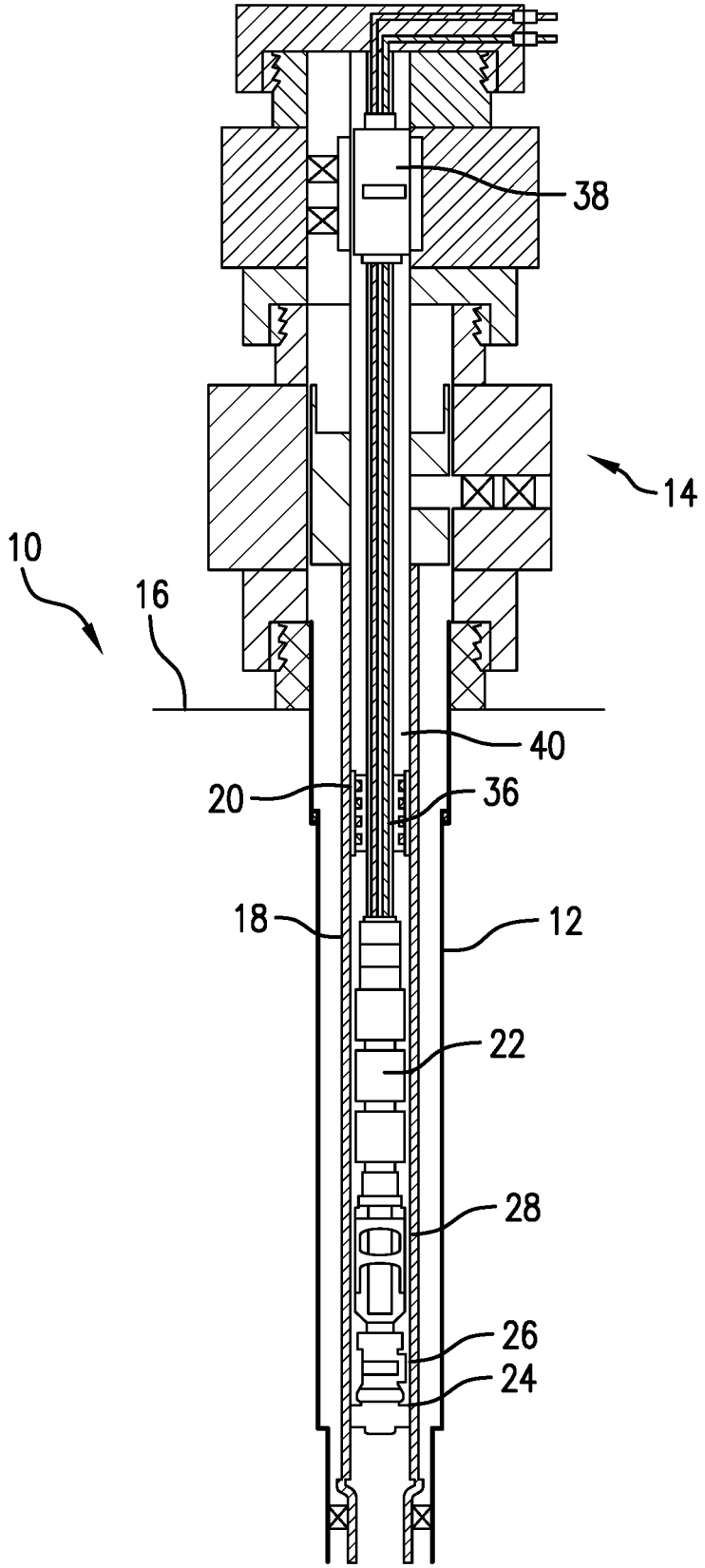
FIG. 1 depicts a schematic view of a well system constructed in accordance with the method hereof.

Referring to FIG. 1, a system 10 is illustrated that provides artificial lift capability to a well. FIG. 1 includes both preexisting structure of a previous well and new structure installed pursuant to the present method to provide for artificial lift function in the well together these form the system. The system comprises a borehole 12 that is from the preexisting subsea. The borehole 12 is in operable communication with a tree 14, which is disposed at a surface location 16 (generally sea floor). A production string 18 extends into the borehole 12 from the tree 14 and includes a surface controlled subsurface safety valve (SCSSV) 20 disposed in the production string 18. After formation pressure drops below a level associated with acceptable production, consideration of alternatives must be undertaken. Production can of course be restored through a conventional workover to install an artificial lift system but as noted above the cost is significant. In particular wells that do not have a likelihood of future recovery that monetarily supports the investment in a conventional workover, have traditionally been shut in and abandoned. Prior to this disclosure there has been no option for further utility of the well. Accordingly, the present method has been developed to create a system that works with the pre-existing portions noted above to put wells such as those described back on production using a new method for installing artificial lift without the need for or cost of a conventional workover.

Figure 2:
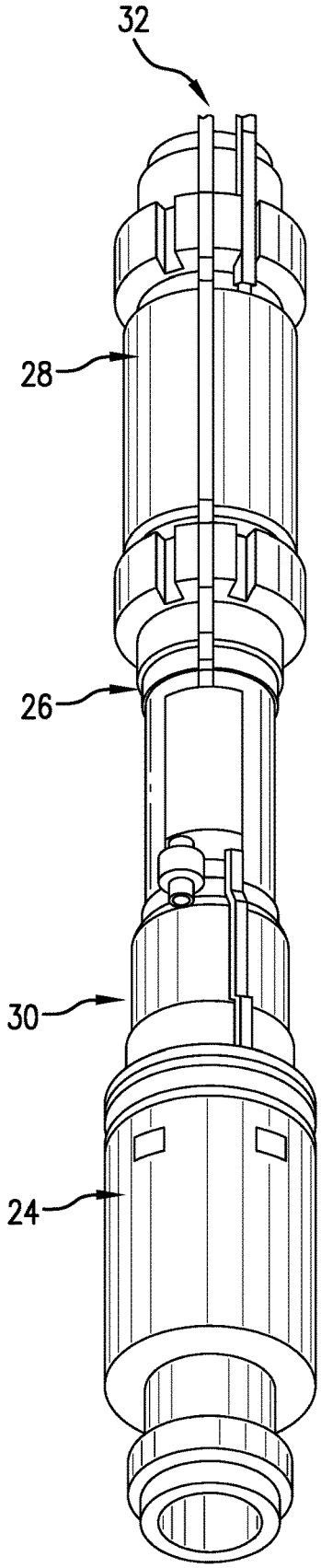
FIG. 2 is a further enlarged view of components below an ESP supportive of the method hereof.

The method comprises assembling the components of FIG. 2 to the downhole end of an electric submersible pump (ESP) 22. The components are all known to the art but have not been assembled in this way heretofore. Referring to FIG. 2, a packer 24, chemical injection sub 26 and SCSSV 28 are assembled together optionally using an offset sub 30 as shown. These components are provided with a wet connect 32 that will function to connect (hydraulically, electrically, chemical injectingly, etc.) the components (and potentially other more downhole devices) to the ESP 22 and back to surface. More specifically, any "services" needed below the ESP 22 will need to be supplied through the wet connect 32. These may be hydraulic lines for setting the packer 24 or actuating the SCSSV 28, chemical injection line(s) for the chemical injection sub 26, electrical line(s) for anything needing power below the ESP, etc. All of the components discussed in this paragraph are individually commercially available from Baker Hughes Incorporated Houston, Tex.

In order to restore functionality to the ailing hypothetical well, a string comprising each of the components discussed in the paragraph above with the addition of a piggyback sleeve 36 (also individually commercially available from Baker Hughes Incorporated) at the bottom of the packer 24 is made up to the bottom of the ESP 22, which itself is attached to a conduit 34 capable of both supporting the ESP physically and supplying the ESP with power. In one iteration, the conduit 34 is a length of coiled tubing having an electrical conductor therein. In alternate arrangements, the conduit 34 may be any other type of power cable with tensile strengthening provisions such as wire rope, etc. The foregoing are all hung by a hanger 38 in the tree 14. The made up components are run into the well through the original production string 18 and through the original SCSSV 20 to a target position in the borehole 12 where the ESP 22 is to provide lift for production fluids. It will be appreciated both from FIG. 1 and from reading the foregoing that the conduit 34 will be resident in the original SCSSV 20 thereby interfering with its function. The piggyback sleeve will hold the SCSSV 20 open to avoid interference with the conduit 34.

The piggyback sleeve 36 (shown only in final position within the valve 20) is a device known to the art and whose function it is to hold an SCSSV open after running through the valve. Further detail of the piggyback appearance or function is not necessary in view of its well-known nature.

The fact that the SCSSV 20 is to be held open for through passage of the conduit 34 is the reason for much of the componentry below the ESP 22. As one of ordinary skill in the art knows, primary well control is always paramount. Therefore a primary well control valve such as SCSSV 20 must be operational at all times to provide for primary well control. If an ESP were to be deployed as is done here without the other componentry disclosed herein, rules and regulations would be broken due to the conduit 34 interfering with operation of the valve 20. In view hereof, a primary well control capability must be provided for in the system disclosed herein in order to be viable. In an embodiment the primary well control capability may be provided by the components illustrated. In such an embodiment the SCSSV 28 is included to become the primary well control device to replace the function of the existing safety valve 20. Packer 24 is included to become a well barrier device used in conjunction with the SCSSV 28 to provide the primary well control. These together reliably and simply provide for the primary well control capability needed.

It will be understood that an injection point for chemical treatment is a valuable tool to have during ESP operation and so the chemical injection sub 26 has been added to the system though it should be understood to be more optional than the primary well control components. The well may be put back on production after creating the system disclosed herein by running the components discussed into the production string 18 and through the valve 20. Once on production, production fluid is moved through the ESP and then toward surface in an annular space 40 between the conduit 34 and the production string 18.

Since the ESP 22 is connected to the lower components through the wet connect 32, when the ESP reaches an end of its service life, and since the components downhole of the ESP provide complete well control, the ESP can be disconnected from the other components, the well blown down and the ESP 22 and conduit 34 removed from the production tubing 18 without further well control being necessary.

The wet connect 32 is also, as one will expect, capable of reconnection with a new (or repaired) ESP 22 run on the conduit 34 such that all "services" will be restored to the components downhole of the ESP and production may be resumed.

Set forth below are some embodiments of the foregoing disclosure:

Embodiment 1

A method for providing well safety control in a remedial electronic submersible pump (ESP) application comprising making up an electric submersible pump (ESP) on a conduit with a primary well control capability; running the foregoing through a preexisting SCSSV.

Embodiment 2

The method in any of the preceding embodiments including activating the primary well control capability.

Embodiment 3

The method in any of the preceding embodiments including pumping production fluid with the ESP through an annular space between a pre-existing production tubing string and the conduit.

Embodiment 4

The method in any of the preceding embodiments, wherein the making up further positioning a piggyback sleeve to interact with a pre-existing SCSSV in the well.

Embodiment 5

The method in any of the preceding embodiments, wherein the making up further includes disposing a chemical injection sub downhole of the ESP.

Embodiment 6

The method in any of the preceding embodiments wherein the making up further includes disposing a wet connect between the ESP and the primary well control capability.

Embodiment 7

The method in any of the preceding embodiments, wherein the wet connect is positioned downhole of the ESP.

Embodiment 8

The method in any of the preceding embodiments, wherein the wet connect is capable of disconnect and reconnect.

Embodiment 9

The method in any of the preceding embodiments, wherein activating the primary well control capability includes setting a packer in communication with a surface controlled subsurface safety valve (SCSSV) downhole of the ESP.

Embodiment 10

The method in any of the preceding embodiments, wherein the conduit is a length of coiled tubing having a conductor therein.

Embodiment 11

The method in any of the preceding embodiments, wherein the conduit is a length of power cable having a tensile strengthening member associated therewith.

Embodiment 12

The method in any of the preceding embodiments including disconnecting the wet connect, blowing down the well and pulling the ESP to surface.

Embodiment 13

The method in any of the preceding embodiments running an ESP into the well and connecting to the wet connect.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method for providing well safety control in a remedial electronic submersible pump (ESP) application comprising:

making up an electric submersible pump (ESP) on a conduit with including a primary well control capability;

running the ESP, conduit and primary well control capability through a preexisting Surface Controlled Subsurface Safety Valve) SCSSV, thereby impeding normal operation of the SCSSV.

2. The method as claimed in claim 1 further comprising activating the primary well control capability.

3. The method as claimed in claim 2 wherein activating the primary well control capability includes setting a packer in communication with a surface controlled subsurface safety valve (SCSSV) downhole of the ESP.

4. The method as claimed in claim 1 further comprising pumping production fluid with the ESP through an annular space between a pre-existing production tubing string and the conduit.

5. The method as claimed in claim 1 wherein the making up further includes positioning a piggyback sleeve to interact with the pre-existing SCSSV in the well.

6. The method as claimed in claim 1 wherein the making up further includes disposing a chemical injection sub downhole of the ESP.

7. The method as claimed in claim 1 wherein the making up further includes disposing a wet connect between the ESP and the primary well control capability.

8. The method as claimed in claim 7 wherein the wet connect is positioned downhole of the ESP.

9. The method as claimed in claim 7 wherein the wet connect is capable of disconnect and reconnect.

10. The method as claimed in claim 7 further comprising:

disconnecting the wet connect, blowing down the well and pulling the ESP to surface.

11. The method as claimed in claim 10 further comprising running an ESP into the well and connecting to the wet connect.

12. The method as claimed in claim 1 wherein the conduit is a length of coiled tubing having a conductor therein.

13. The method as claimed in claim 1 wherein the conduit is a length of power cable having a tensile strengthening member associated therewith.

* * * * *